United States Patent [19]

Snow

[11] 4,246,556

[45] Jan. 20, 1981

[54] LOW PARASITIC SHUNT DIODE PACKAGE

[75] Inventor: Philip B. Snow, Hillsboro, Oreg.

[73] Assignee: Tektronix, Inc., Beaverton, Oreg.

[21] Appl. No.: 18,961

[22] Filed: Mar. 9, 1979

[51] Int. Cl.[3] ..... H01P 5/04; H01P 11/00; H01P 7/04

[52] U.S. Cl. ..... 333/247; 333/223; 333/245

[58] Field of Search ..... 333/247, 245, 258, 262, 333/102, 222–226, 231–233; 29/589, 590–591; 357/80, 74; 330/4.9; 331/107 G, 107 T, 96

[56] References Cited

U.S. PATENT DOCUMENTS

| | | | |
|---|---|---|---|
| 3,668,551 | 6/1972 | Kondo | 331/107 G |
| 3,896,543 | 7/1975 | Colliver et al. | 29/590 |
| 3,916,350 | 10/1975 | Swan | 333/262 |

*Primary Examiner*—Marvin L. Nussbaum
*Attorney, Agent, or Firm*—William D. Haffner

[57] ABSTRACT

A removable diode package for mounting beam-lead diodes in coaxial, stripline or waveguide microwave circuits is described. The diode package is capable of operation at frequencies above 40 GHz. A low-dielectric polyimide insulating washer is used to reduce parasitic elements normally associated with diode packages at microwave and millimeter frequencies.

9 Claims, 2 Drawing Figures

LOW PARASITIC SHUNT DIODE PACKAGE

BACKGROUND OF THE INVENTION

The present invention relates to packaging and mounting beam-lead diodes in a stripline, coaxial or waveguide assembly.

Beam-lead technology is ideally suited to the production of diodes which must operate at high frequencies with low loss due to parasitic elements associated with the elements of the device. Beam-lead diodes also provide excellent mechanical reliability and can be protected by an appropriate encapsulant which adds negligibly to device parasitics without degrading RF performance. Beam-lead devices are easily adapted to mounting in microwave-integrated circuitry but difficult to adapt to other environments. This occurs because the diode is normally bonded in place and field replacement is difficult if not impossible.

Semiconductor chip diodes have been successfully packaged in various configurations. Usually these packages contain a spring-loaded pin or a fine gold wire to contact the enclosed semiconductor chip. The pin and the wire contribute a parasitic inductance in series with the semiconductor. Parasitic capacitance contributed by the cross-sectional area of the pin and end contacts of the package in conjunction with the parasitic inductance create spurious resonances that make satisfactory operation above 30 GHz nearly impossible. For more information concerning parasitic elements associated with conventional packaged and mounted diodes the article "The Packaged and Mounted Diode as a Microwave Circuit" by W. J. Getsinger, IEEE Transactions on Microwave Theory and Techniques, vol. MTT-14, No. 2, February, 1966, pp 58–69, which is incorporated herein by reference.

U.S. Pat. No. 3,974,518 discloses a package for microwave diodes wherein the semiconductor chip is mounted upon a diamond member embedded in a copper base member so that the diamond mounting surface and the copper base member surface are coplanar. A quartz insulator surrounds the chip and reduces parasitic capacitances to an extent. However, the diode is suitable for X-band (up to 8–12.5 GHz) operation only.

What is needed then is a packaging and mounting method apparatus and method for removably mounting a beam-lead diode in a coaxial, stripline or waveguide assembly that does not appreciably degrade device performance in the microwave and millimeter frequency ranges.

SUMMARY OF THE INVENTION

A beam-lead diode is packaged so as to reduce parasitic capacitance at frequencies above 40 GHz. One electrode lead of the diode is welded to the flat face of a tuning screw while the other is welded to a gold disk. The diode is surrounded by a low dielectric polyimide insulating washer which does not substantially increase the inherently low parasitic elements associated with beam-lead diodes.

Therefore, it is an object of the present invention to provide a diode package that is capable of efficient operation at frequencies above 40 GHz.

It is another object of the present invention to provide a microwave diode package that can be easily mounted and removed from a coaxial, stripline or waveguide microwave assembly.

The subject matter which I regard as my invention is particularly pointed out and distinctly claimed in the concluding portion of this specification. The invention, however, both as to organization and method of operation, together with further advantages and objects thereof may be best understood by reference to the following description taken in conjunction with the accompanying drawing.

DETAILED DESCRIPTION OF THE PREFERRED EMBODIMENT

Figure 1:
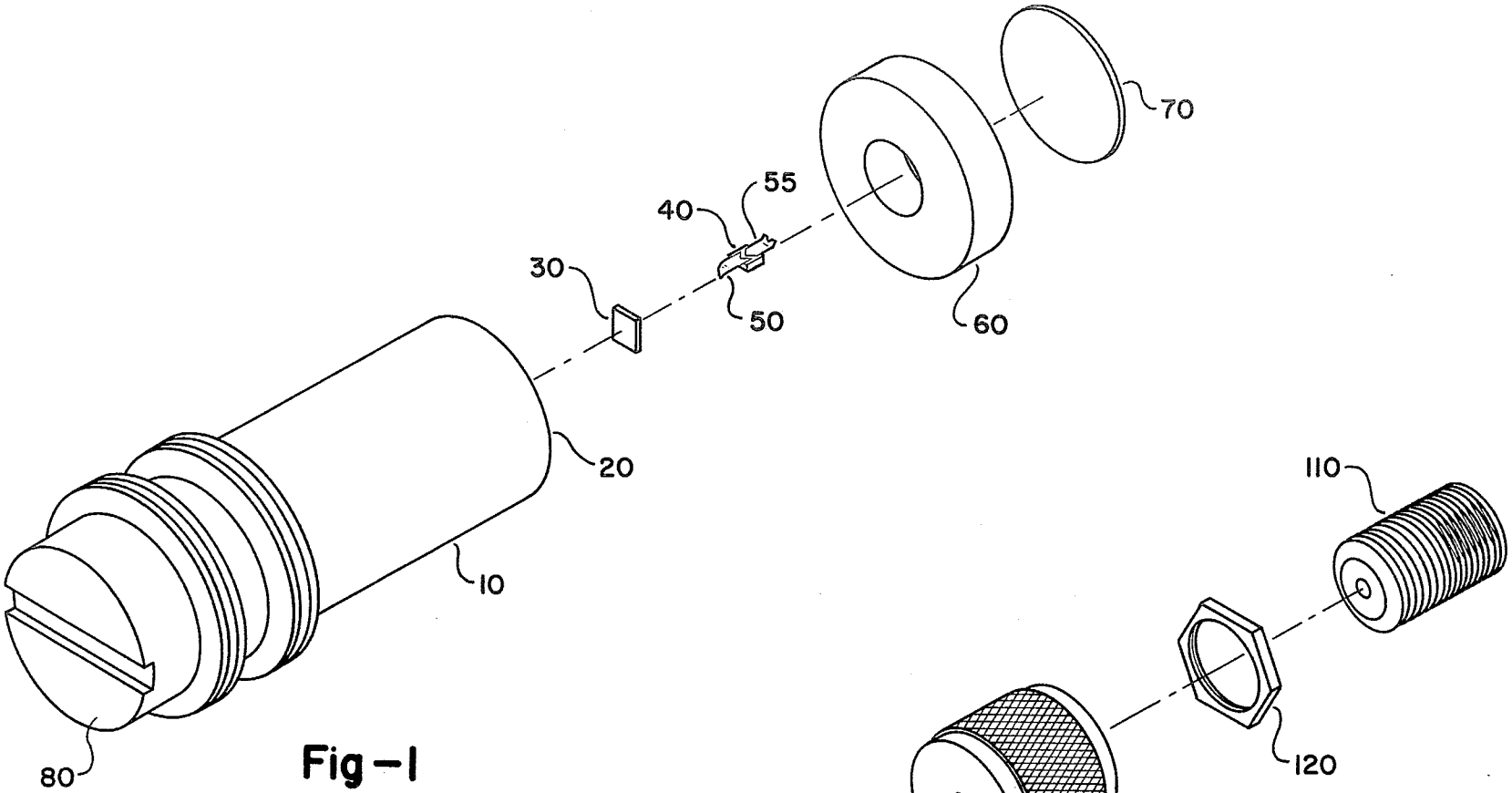
FIG. 1 is an exploded view of an embodiment of present invention.

Referring now to FIG. 1, I have illustrated therein a beam-lead diode packaged in accordance with the present invention.

Beam-lead diode 40 is mounted on a flat end 20 of a tuning screw 10 which may be removably mounted in a coaxial, stripline or waveguide assembly. The beam-lead diode 40 may be of any desired type such as a Schottky diode. Beam-lead diodes are well known in the art; those desiring more information concerning beam-lead devices are referred to the article "Beam-Lead Schottky-Barrier Diodes for Low-Noise Integrated Microwave Mixers," by N. P. Cerniglia, et. al., IEEE Transactions on Electron Devices, Vol. ED-15, No. 9, September 1968, pp. 674–678, which is incorporated herein by reference. The tuning screw may be of any desired type which is made from an electrical conductor, for example, a Johanson 3/32"–80 gold-plated brass tuning screw. Connected to one lead of the diode is a 0.001-inch thick by 0.010-inch by 0.010-inch gold ribbon 30 which is initially attached to a flat face 20 of the tuning screw. The other lead of the diode 40 is connected to a 0.002-inch thick 0.050-inch diameter gold disk 70.

Diode 40 is surrounded by a polyimide insulating washer 60. The polyimides herein referred to are members of the class of plastics sometimes known as heteroaromatics; they are polymers with excellent thermal capability and resistance to temperature as high as 600° F. Polyimides are available in various forms including films. They have dielectric constants (at 1 MHz) of from 3.55 to 5.2. The polyimide chosen for one embodiment of the present invention is one that has a dielectric constant of 3.55 and sold under the tradename of Vespel SP-1 by E. I. DuPont de Nemours & Co., 1007 Market Street, Wilmington, Del 19898.

In accordance with the present invention, the flat face 20 of tuning screw 10 is first cleaned with alcohol to prepare the surface. Gold ribbon 30 is gap welded to the center of the flat face 20. One electrode lead 50 of beam-lead diode 40 is then gap welded to gold ribbon 30 and bent into an L-shape to align with the tuning screw axis as shown in FIG. 1. A commercially available gold-filled epoxy is then applied around the circumference of the tuning screw face. An insulating washer 60 which has been punched from a sheet of the previously described polyimide material is concentrically placed over the beam-lead diode and pressed into contact with the epoxy-coated tuning screw flat face 20. The diode package is placed in an oven heated to 150 degrees Celsius to cure the epoxy. After the epoxy has cured, the free electrode lead 55 of diode 40 is dressed over the top face of polyimide insulating washer 60 and gold-filled epoxy is applied around the top face of washer 60. Gold disk 70 is placed over the epoxy in contact with electrode lead 55. The package is again placed in a 150-degree oven to cure the epoxy. Gold disk 70 is one electrical contact for the diode package while tuning screw surface 80 is the other.

The above-described preferred embodiment has been successfully operated at frequencies above 40 GHz with no noticeable decrease in performance. It has also been tested in a wave guide mixer at 90 GHz with only 10 dB degradation in conversion loss compared to a "whisker" probed diode waveguide mixer.

Figure 2:
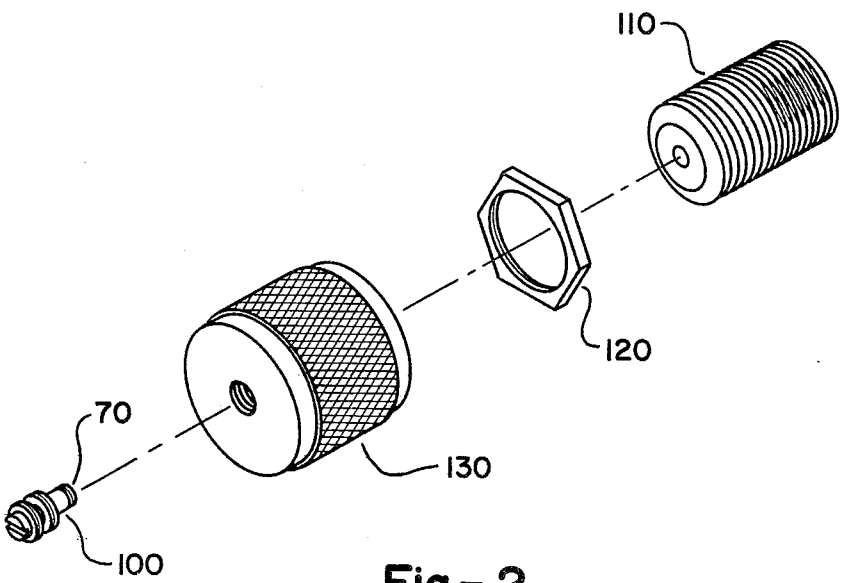
FIG. 2 is an exploded view of the packaged diode mounted in a coaxial assembly.

Referring now to FIG. 2, I have illustrated how the packaged diode 100 may be mounted in a coaxial assembly. The assembly consists of electrical connector 110, locking nut 120, housing 130, and diode 100. Threaded electrical connector 110 is screwed into the large threaded hole in housing 130. Nut 120 is screwed over electrical connector 110 to a snug fit. The diode package 100 is then screwed into the small hole in housing 130 until electrical connection is made between electrical contact 70 and electrical connector 110.

While I have shown and described a preferred embodiment of my invention, it will be apparent to those skilled in the art that many changes and modifications may be made without departing from my invention in its broader aspects. I therefore intend the appended claims to cover all such changes and modifications as fall within the scope of my invention.

I claim as my invention:

1. A diode package suitable for use at frequencies up to above 40 GHz for mounting a beam-lead diode in a stripline, coaxial or waveguide assembly, the diode having a first and second electrode, the package comprising:

an electrically conductive tuning screw having at least one flat face;

a gold ribbon mounted on said flat face of said tuning screw and connected to the first electrode of the beam-lead diode;

an annular insulating member having a low dielectric constant surrounding the beam-lead diode and mounted on said flat face of said tuning screw; and an electrical conducting member mounted on said annular insulating member, said second electrical member being electrically connected to said second electrode.

2. The diode package according to claim 1 wherein said annular insulating member is a washer comprising a polyimide material.

3. The diode package according to claim 1 wherein said electrical conducting member is a gold disk.

4. The diode package according to claim 1 wherein said gold ribbon is welded to said flat face of said tuning screw and said first electrode of said beam-lead diode.

5. The diode package according to claim 1 wherein said annular insulating member is attached to said removable mounting member and said electrical conducting member with gold-filled epoxy.

6. A method of packaging a beam-lead diode for mounting in a coaxial, stripline or waveguide assembly for operation at frequencies up to above 40 GHz, comprising the steps of:

(a) gap welding a first electrical conductor to a flat face of an electrically conductive removable mounting member;

(b) attaching a first electrode of the beam-lead diode to said first electrical conductor;

(c) mounting an annular insulating member around said beam-lead diode; and (d) mounting a second electrical conductor on said annular insulating member, said second electrical conductor also being electrically connected to a second electrode of the beam-lead diode.

7. The method according to claim 6 wherein step (b) comprises gap welding said first electrode of the beam-lead diode to said first electrical conductor.

8. The method according to claim 6 wherein step (c) further comprises attaching said annular insulating member to said flat face of said electrically conductive removable mounting member with gold-filled epoxy.

9. The method according to claim 6 wherein step (d) further comprises attaching said second electrical conductor to said second electrode of the beam-lead diode with gold-filled epoxy.

* * * * *